US007899345B2

(12) United States Patent
Ishii

(10) Patent No.: US 7,899,345 B2
(45) Date of Patent: Mar. 1, 2011

(54) WASTE TONER COLLECTING DEVICE AND IMAGE FORMING APPARATUS

(75) Inventor: Jun Ishii, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 181 days.

(21) Appl. No.: 12/208,991

(22) Filed: Sep. 11, 2008

(65) Prior Publication Data

US 2009/0074434 A1 Mar. 19, 2009

Related U.S. Application Data

(60) Provisional application No. 60/972,225, filed on Sep. 13, 2007.

(51) Int. Cl.
*G03G 21/12* (2006.01)

(52) U.S. Cl. ..... 399/35; 399/360

(58) Field of Classification Search ..... 399/35, 399/101, 360

See application file for complete search history.

(56) References Cited

U.S. PATENT DOCUMENTS

| | | | | |
|---|---|---|---|---|
| 6,731,885 | B2 * | 5/2004 | Anthony et al. | 399/35 |
| 7,239,841 | B2 * | 7/2007 | Jeong et al. | 399/360 X |
| 7,330,678 | B2 * | 2/2008 | Kadowaki et al. | 399/360 X |
| 7,392,007 | B2 * | 6/2008 | Nakano et al. | 399/101 X |

FOREIGN PATENT DOCUMENTS

| | | |
|---|---|---|
| JP | 2002-149022 | 5/2002 |
| JP | 2002-149023 | 5/2002 |

* cited by examiner

*Primary Examiner*—Sandra L Brase
(74) *Attorney, Agent, or Firm*—Patterson & Sheridan, LLP

(57) ABSTRACT

A waste toner collecting device includes a box that stores a waste toner unnecessary in image formation, a collection port that is provided in an upper part of a main body of the box, receives the waste toner, and drops the waste toner into the box, a triangular obstacle provided in a position opposed to a falling port for the waste toner and near a bottom surface in the box, and a sensor that is provided in a position lower than the collection port and higher than the obstacle and detects that an amount of the waste toner stored in the box reaches a predetermined amount.

22 Claims, 8 Drawing Sheets

WASTE TONER COLLECTING DEVICE AND IMAGE FORMING APPARATUS

CROSS-REFERENCE TO RELATED APPLICATION

This application is based upon and claims the priority from U.S. Provisional Application No. 60/972,225 filed on Sep. 13, 2007, the entire contents of which are incorporated herein by reference.

TECHNICAL FIELD

The present invention relates to an image forming apparatus of an electrophotographic system that superimposes toners of plural colors to obtain a color image, and, more particular to an image forming apparatus including a waste toner collecting device that collects a used waste toner.

BACKGROUND

In general, in an image forming apparatus of an electrophotographic system, plural photoconductive drums are arranged in parallel and toner images of plural colors formed on the respective photoconductive drums are multiply transferred onto a sheet to obtain a color image. In such an image forming apparatus, a residual toner remains on each of the photoconductive drums. When an intermediate transfer belt is used, a residual toner also remains on the intermediate transfer belt.

Therefore, the residual toners remaining on the plural photoconductive drums and the intermediate transfer belt are removed by cleaning devices such as blades. The removed residual toners (waste toners) are collected in a waste toner box.

In the waste toner box in the past, when the waste toner box is filled with the waste toner, it is detected by an optical sensor that the waste toner box is full. The waste toner box is replaced with a new waste toner box. The waste toner falls from a collection port of the box and piles up below the collection port in a mountain shape. The height of the waste toner in the box is the largest in a portion where the waste toner piles up in the mountain shape. Therefore, the sensor is set in a position where the sensor can detect, before the mountain-like portion reaches the collection port, that the box is filled with the waste toner.

JP-A-2002-149022 and JP-A-2002-149023 disclose image forming apparatuses including waste toner containers.

In some image forming apparatus, a system for performing development while replacing a carrier little by little is adopted. The mountain shape of the waste toner formed in the box is different depending on the content of the carrier in the waste toner. The mountain shape is also different depending on an amount of the waste toner. Therefore, even if the sensor detects that the box is full, an amount of the waste toner in the box may fluctuate.

SUMMARY

It is an object of the present invention to provide a waste toner collecting device and an image forming apparatus adapted to stabilize a shape of a waste toner that piles up in a waste toner box.

According to an aspect of the present invention, there is provided a waste toner collecting device that collects a waste toner unnecessary in image formation, the waste toner collecting device including a box that stores the waste toner, a collection port that is provided in an upper part of a main body of the box, receives the waste toner, and drops the waste toner into the box, a triangular obstacle provided in a position opposed to a falling port for the waste toner and near a bottom surface in the box, and a sensor that is provided in a position lower than the collection port and higher than the obstacle and detects that an amount of the waste toner stored in the box reaches a predetermined amount.

DETAILED DESCRIPTION

Figure 1:
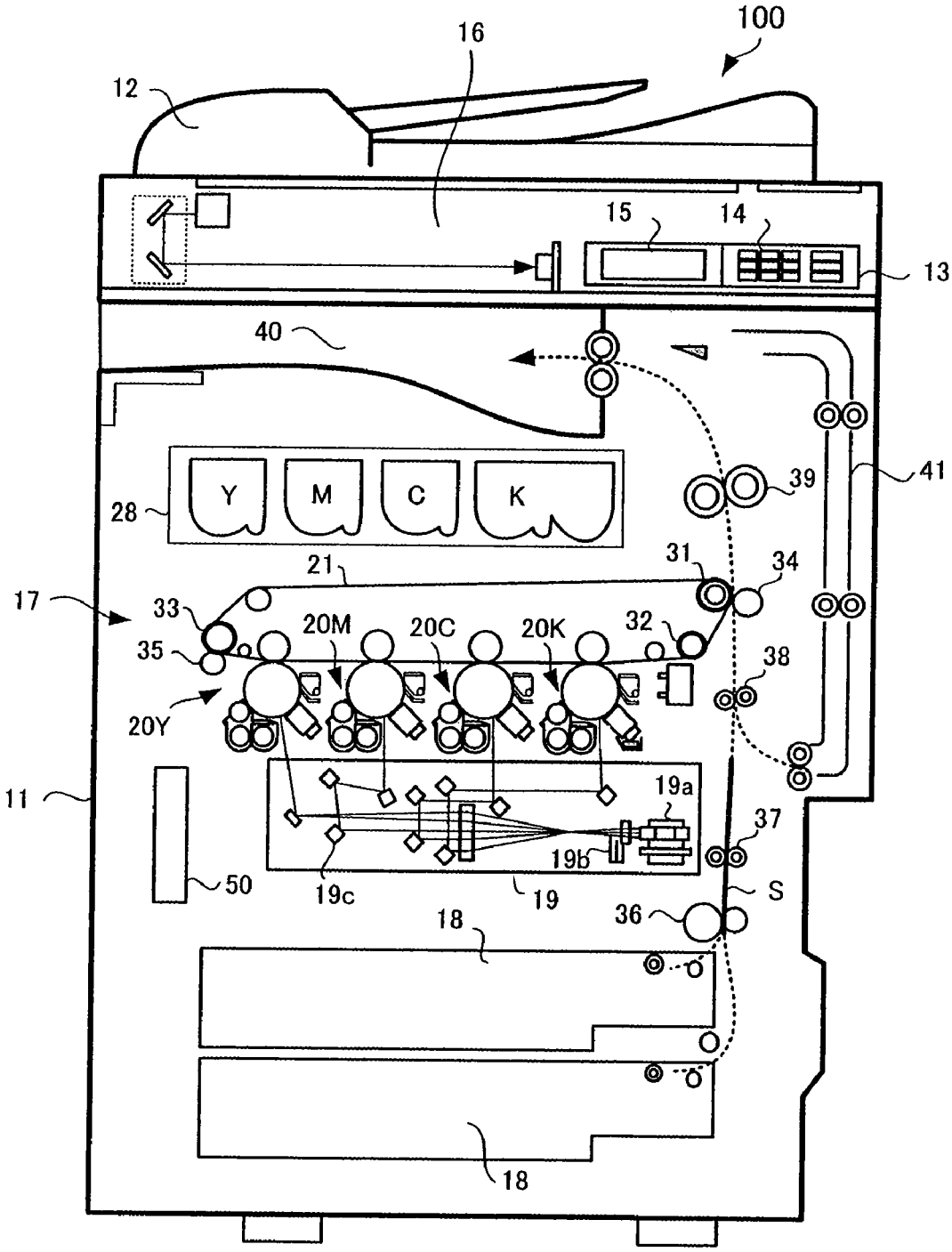
FIG. 1 is a front view showing an image forming apparatus according to an embodiment.

Throughout this description, the embodiment and example shown should be considered exemplars, rather than limitations on the apparatus of the present invention.

An embodiment of the present invention is explained in detail below with reference to the accompanying drawings. In the figures, the same components are denoted by the same reference numerals and signs.

FIG. 1 is a diagram showing an image forming apparatus according to the embodiment. In FIG. 1, reference numeral 100 denotes the image forming apparatus. The image forming apparatus is, for example, an MFP (multi-function peripheral) as a complex machine, a printer, or a copying machine. In the following explanation, an MFP is explained as an example of the image forming apparatus 100.

A document table (not shown) is provided in an upper part of a main body 11 of the MFP 100. An automatic document feeder (ADF) 12 is openably and closably provided on the document table. An operation panel 13 is provided in an upper part of the main body 11. The operation panel 13 has an operation unit 14 including various keys and a display unit 15 of a touch panel type.

A scanner unit 16 is provided below the ADF 12 in the main body 11. The scanner unit 16 scans an original document fed by the ADF 12 or an original document placed on the document table and generates image data. A printer unit 17 is provided in the center in the main body 11. Plural cassettes 18 that store sheets of various sizes are provided in a lower part of the main body 11.

The printer unit 17 includes photoconductive drums and a laser (details of which are described later). The printer unit 17 processes the image data scanned by the scanner unit 16 and image data created by a PC (personal computer) or the like and forms an image on a sheet.

The sheet having the image formed thereon by the printer unit 17 is discharged to a paper discharge unit 40. The printer unit 17 includes, for example, a color laser printer of a tandem system. The printer unit 17 scans a photoconductive member with a laser beam from a laser exposing device 19 and generates an image.

The printer unit 17 includes image forming units 20Y, 20M, 20C, and 20K for respective colors of yellow (Y), magenta (M), cyan (C), and black (K). The image forming units 20Y, 20M, 20C, and 20K are arranged in parallel below an intermediate transfer belt 21 from an upstream side to a downstream side.

In the following explanation, since the image forming units 20Y, 20M, 20C, and 20K have the same configuration, the image forming unit 20Y is explained below as a representative image forming unit. The structure of details of the image forming units 20Y, 20M, 20C, and 20K is shown in FIG. 2 in enlargement.

Figure 2:
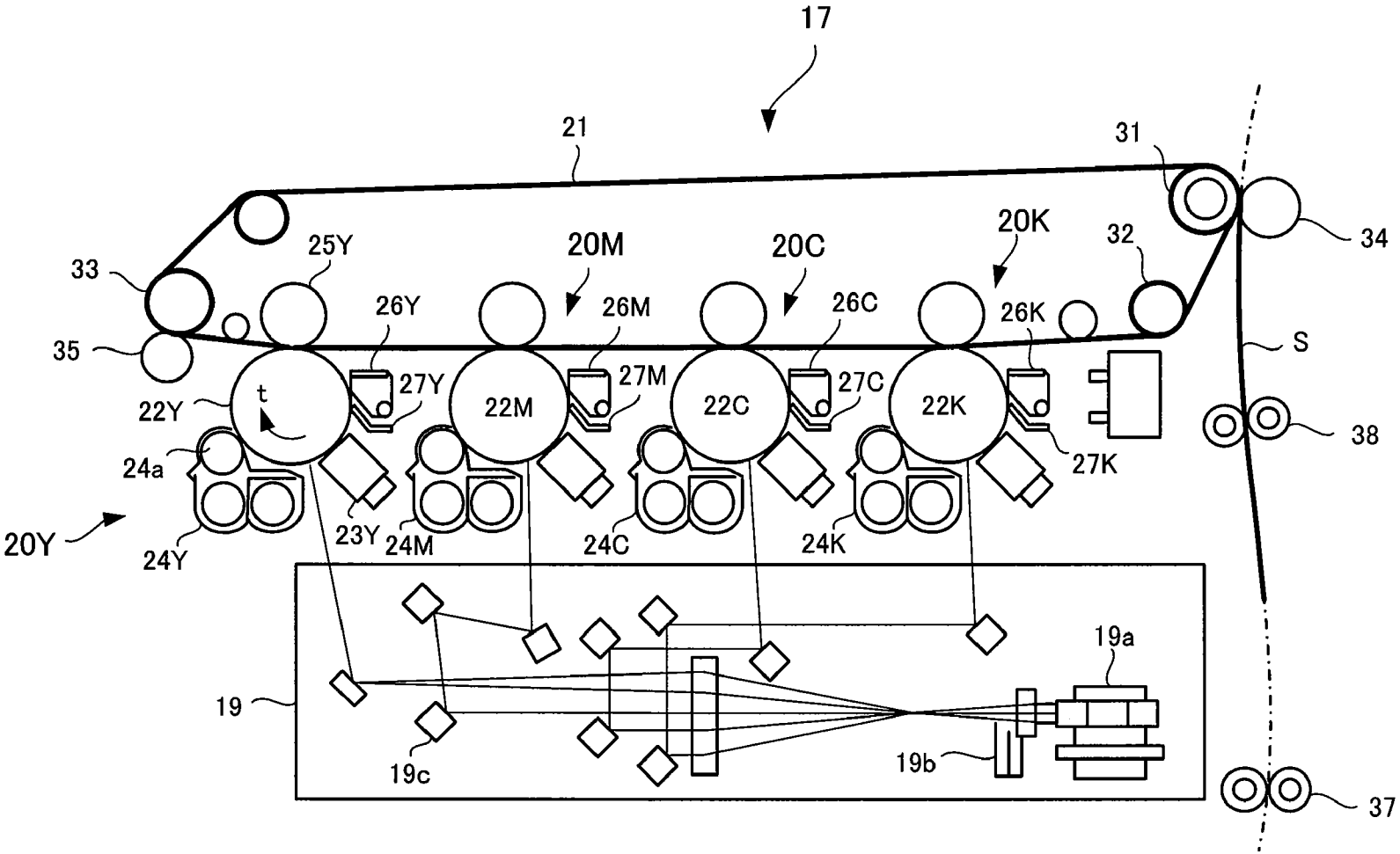
FIG. 2 is a diagram showing the internal structure of the image forming apparatus.

As it is seen from FIG. 2, the image forming unit 20Y has a photoconductive drum 22Y as an image bearing member. An electrifying charger 23Y, a developing device 24Y, a primary transfer roller 25Y, a cleaner 26Y, a blade 27Y, and the like are arranged around the photoconductive drum 22Y along a rotating direction t of the photoconductive drum 22Y. A yellow laser beam from the laser exposing device 19 is irradiated on an exposing position of the photoconductive drum 22Y to form a latent image on the photoconductive drum 22Y.

The electrifying charger 23Y of the image forming unit 20Y uniformly charges the surface of the photoconductive drum 22Y. The developing device 24Y supplies a two-component developer including a yellow toner and a carrier to the photoconductive drum 22Y using a developing roller 24*a* to which a developing bias is applied. The cleaner 26Y removes a residual toner on the surface of the photoconductive drum 22Y using the blade 27Y.

Toner cartridges 28 (FIG. 1) that supply toners to the developing devices 24Y to 24K are provided above the image forming units 20Y to 20K. The toner cartridges 28 include toner cartridges for the respective colors of yellow (Y), magenta (M), cyan (C), and black (K).

The intermediate transfer belt 21 circulatingly moves. For example, semi-conductive polyimide is used for the intermediate transfer belt 21 from the viewpoint of heat resistance and abrasion resistance. The intermediate transfer belt 21 is looped around a driving roller 31 and driven rollers 32 and 33 and is opposed to and in contact with photoconductive drums 22Y to 22K. A primary transfer voltage is applied to a position of the intermediate transfer belt 21 opposed to the photoconductive drum 22Y by the primary transfer roller 25Y to primarily transfer a toner image on the photoconductive drum 22Y onto the intermediate transfer belt 21.

A secondary transfer roller 34 is arranged to be opposed to the driving roller 31 around which the intermediate transfer belt 21 is looped. When a sheet S passes between the driving roller 31 and the secondary transfer roller 34, a secondary transfer voltage is applied to the sheet S by the secondary transfer roller 34 to secondarily transfer the toner image on the intermediate transfer belt 21 onto the sheet S. A belt cleaner 35 is provided near the driven roller 33 of the intermediate transfer belt 21.

On the other hand, the laser exposing device 19 scans a laser beam emitted from a semiconductor laser element in an axial direction of the photoconductive drum 22. The laser exposing device 19 includes a polygon mirror 19*a*, a focusing lens system 19*b*, and a mirror 19*c*.

As shown in FIG. 1, a separation roller 36 that extracts the sheet S in the paper feeding cassette 18, conveying rollers 37, and registration rollers 38 are provided between the paper feeding cassettes 18 and the secondary transfer roller 34. A fixing device 39 is provided downstream of the secondary transfer roller 34.

The paper discharging unit 40 is provided downstream of the fixing device 39. A reversal conveying path 41 is also provided. The reversal conveying path 41 reverses the sheet S and guides the sheet S in a direction of the secondary transfer roller 34. The reversal conveying path 41 is used when duplex printing is performed. Since the reversal conveying path 41 is not the point of the present invention, detailed explanation thereof is omitted.

In order to collect residual toners on the respective photoconductive drums 22Y, 22M, 22C, and 22K and a residual toner on the intermediate transfer belt 21, a waste toner box 50 is provided. Details of a waste toner collecting device including the waste toner box 50 are described later.

Operations of the image forming apparatus 100 shown in FIGS. 1 and 2 are explained. When image data is inputted from the scanner 16, the PC, or the like, images are sequentially formed by the image forming units 20Y to 20K.

The image forming unit 20Y is explained as an example. A laser beam corresponding to image data of yellow (Y) is irradiated on the photoconductive drum 22Y and an electrostatic latent image is formed thereon. A yellow (Y) toner image is formed on the photoconductive drum 22Y by the developing device 24Y. Subsequently, the photoconductive drum 22Y comes into contact with the rotating intermediate transfer belt 21 and primarily transfers the yellow (Y) toner image onto the intermediate transfer belt 21 using the primary transfer roller 25Y.

In the same manner as the yellow (Y) toner image forming process, magenta (M), cyan (C), and black (K) toner images are formed by the image forming units 20M to 20K. The toner images are sequentially transferred onto an identical position where the yellow (Y) toner image is present on the intermediate transfer belt 21. In this way, the yellow (Y), magenta (M), cyan (C), and black (K) toner images are multiply transferred onto the intermediate transfer belt 21 to obtain a full-color toner image.

The intermediate transfer belt 21 secondarily transfers the full-color toner image onto the sheet S collectively using a transfer bias of the secondary transfer roller 34. In synchronization with the full-color toner image on the intermediate transfer belt 21 reaching the secondary transfer roller 34, the sheet S is fed from the paper feeding cassettes 18 to the secondary transfer roller 34. The sheet S having the toner image secondarily transferred thereon reaches the fixing device 39 and the toner image is fixed on the sheet S. The sheet S having the toner image fixed thereon is discharged to the paper discharging unit 40.

On the other hand, after the secondary transfer is finished, a residual toner on the intermediate transfer belt 21 is cleaned by the belt cleaner 35. After the toner image is primarily transferred onto the intermediate transfer belt 21, residual toners on the photoconductive drums 22Y to 22K are removed by cleaners 26Y to 26K and blades 27Y to 27K. The photoconductive drums 22Y to 22K are prepared for the next image formation.

A waste toner collecting device according to the embodiment of the present invention is explained.

Figure 3:
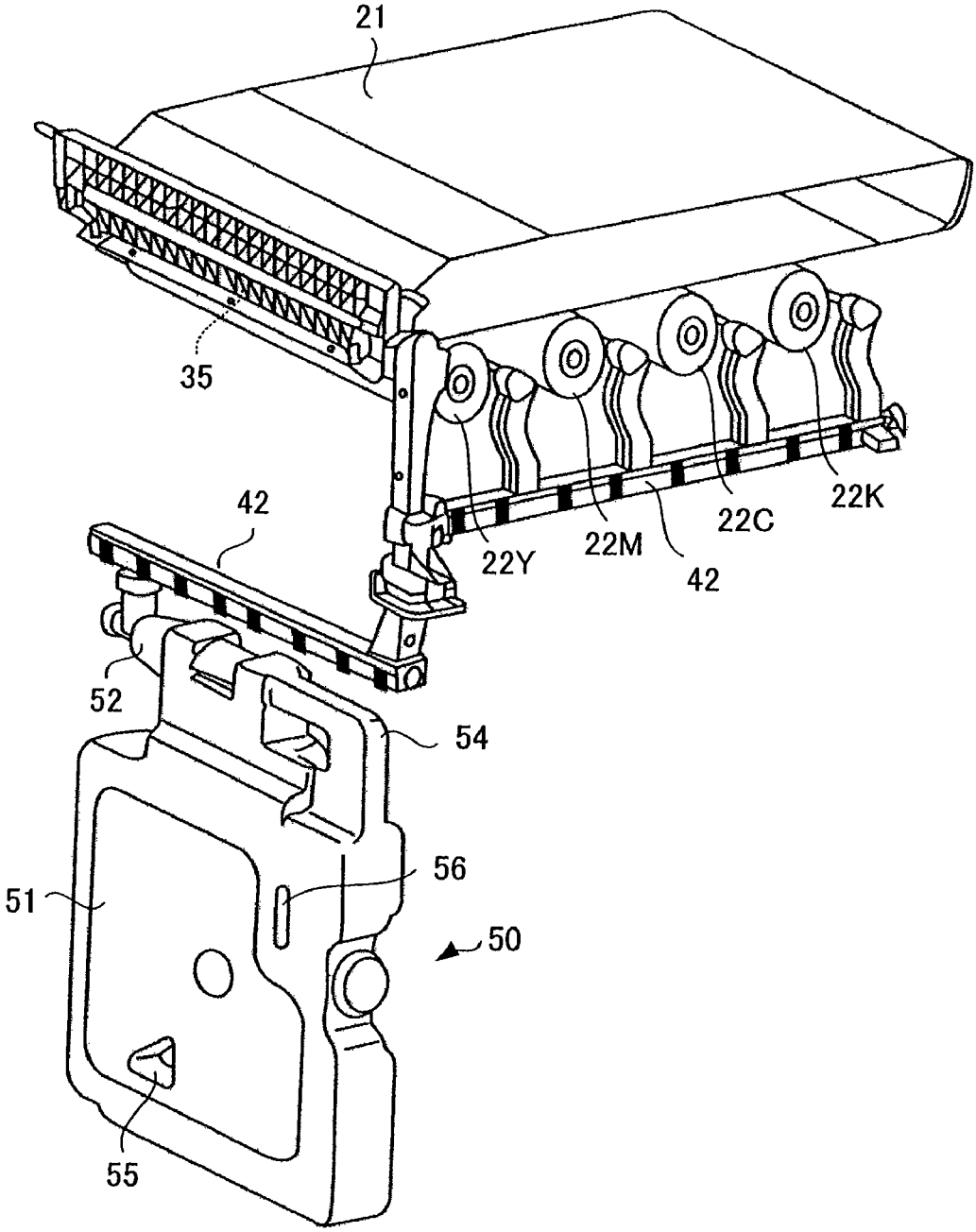
FIG. 3 is a perspective view showing a waste toner collecting device according to the embodiment.

FIG. 3 is a perspective view showing a configuration of a main part of the waste toner collecting device. In FIG. 3, residual toners on the photoconductive drums 22Y to 22K are removed by the cleaners 26Y to 26K and the blades 27Y to 27K (FIG. 2). A residual toner on the intermediate transfer belt 21 is removed by the belt cleaner 35. The removed waste toners are stored in the waste toner box 50 via carrying paths 42.

The carrying paths 42 are arranged between the cleaners 26Y to 26K and the waste toner box 50 and between the belt cleaner 35 and the waste toner box 50.

The waste toner box 50 (which may be referred to as box 50 below) includes a cubic main body 51 that stores a waste toner, a collection port 52 for collecting a waste toner from the carrying paths 42, and a sensor 53 (FIG. 4B) that detects that the waste toner box 50 is full.

Figure 4A:
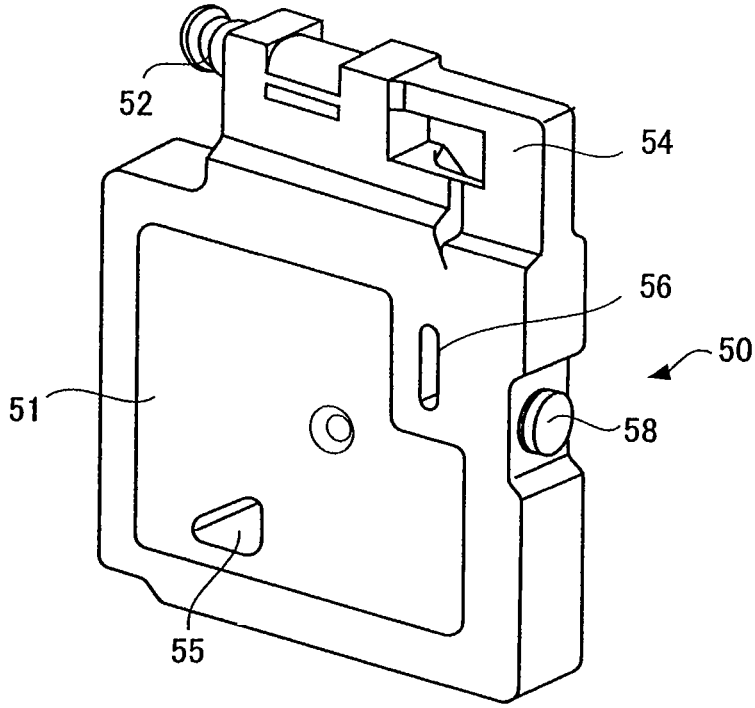
FIGS. 4A and 4B are perspective views of a waste toner box used in the waste toner collecting device.
Figure 4B:
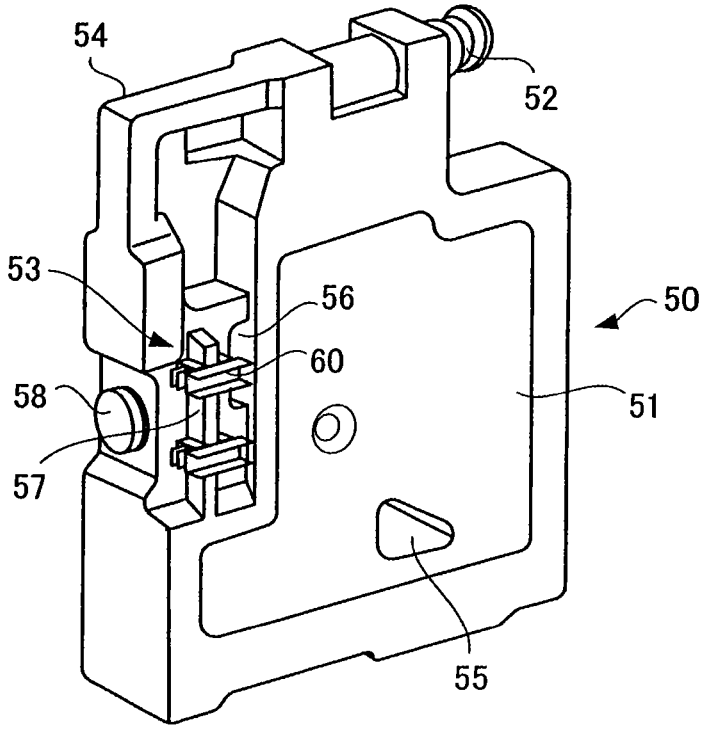

FIGS. 4A and 4B are perspective views of the box 50 viewed from different angles. FIG. 4A is a perspective view of the box 50 viewed from an angle same as that in FIG. 3. FIG. 4B is a perspective view of the box 50 viewed from the back. In the following explanation, it is assumed that a side shown in FIG. 4A is a front side of the box 50 and a side shown in FIG. 4B is a rear side of the box 50.

As shown in FIGS. 4A and 4B, the collection port 52 of the box 50 is provided in a position offset on one side in an upper part of the main body 51. A handle 54 is provided on the opposite side of the collection port 52. An obstacle is formed in a position to which a waste toner falls in a lower part of the box 50. This obstacle is preferably triangular but may be circular. In this embodiment, a hole 55 of a tunnel shape, which pierces from the front side to the rear side of the main body 51, is formed in a lower part of the box 50. The hole 55 is triangular and formed in the position to which the waste toner falls. An oblique side of the triangle corresponds to a falling port for the waste toner. The triangular hole 55 serves as a first obstacle when the waste toner falls. The hole 55 is hereinafter referred to as obstacle 55.

In a position diagonal to the triangular obstacle 55 of the main body 51, a long hole 56 piercing from the front side to the rear side is formed. The long hole 56 serves as a second obstacle when the waste toner falls.

As shown in FIG. 4B, the sensor 53 that detects that the box 50 is full is attached to the rear side of the main body 51. The sensor 53 is attached to a hollow projection 57 protruding from the main body 51 by an attaching member 60. The projection 57 is formed in a position close to the long hole 56 and lower than the collection port 52 and higher than the triangular obstacle 55. The projection 57 is provided in the vertical direction substantially parallel to the long hole 56. The projection 57 configures a sensor attaching section.

A cap 58 is detachably attached to a side of the main body 51. The cap 58 is removed and used for closing the collection port 52 when the waste toner box 50 is replaced with a new one. The cap 58 can prevent the waste toner from spilling.

Figure 5:
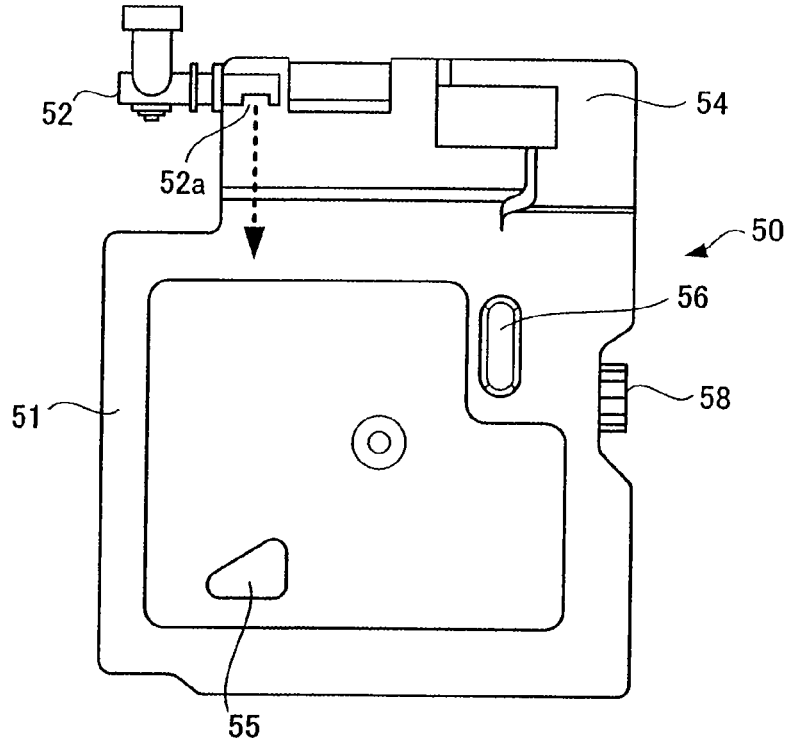
FIG. 5 is a front view of the waste toner box used in the waste toner collecting device.

FIG. 5 is a front view of the waste toner box 50 viewed from the front side. A waste toner carried from the carrying paths 42 is received by the collection port 52. As indicated by a dotted line in FIG. 5, the waste toner falls from a falling port 52*a* toward an inclined surface of the triangular obstacle 55.

Figure 6A:
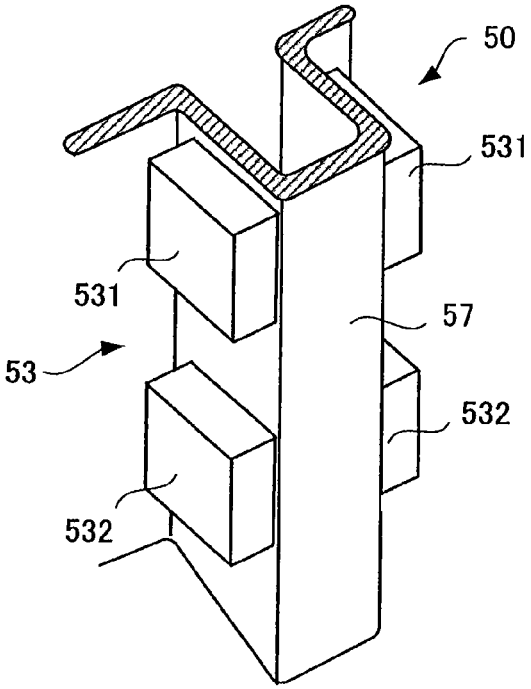
FIGS. 6A and 6B are a perspective view and a sectional view for explaining an arrangement of a sensor in the waste toner collecting device.

FIG. 6A is a perspective view showing the sensor 53 attached to the projection 57. The projection 57 protrudes in a U shape from the main body 51 and formed in the vertical direction. The sensor 53 detects a waste toner accumulated in the projection 57. The sensor 53 includes a first sensor 531 that detects that the box 50 is full and a second sensor 532 that detects a state of the box 50 before becoming full (near full). The sensor 532 that detects the near full is attached to a position lower than the full detection sensor 531.

Figure 6B:
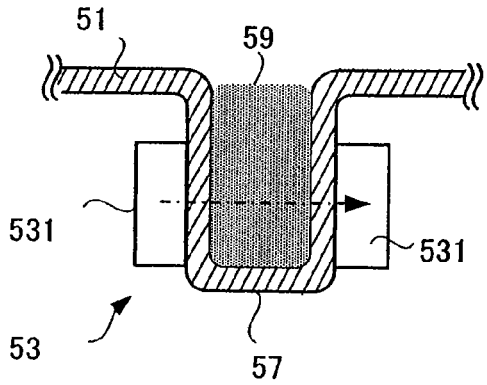

The sensors 531 and 532 are, for example, optical sensors including a pair of a light-emitting element and a light-receiving element. As shown in FIG. 6B, the light-emitting element and the light-receiving element are attached to be opposed to each other across the projection 57.

In a state in which there is only a small amount of a waste toner 59 in the projection 57, light from the light-emitting element is transmitted through the projection 57 and reaches the light-receiving element. However, when the projection 57 is filled with the waste toner 59, the light from the light-emitting element does not reach the light-receiving element due to the waste toner. Therefore, it is possible to detect the full or the near full on the basis of a result of the detection in the light-receiving element. In FIGS. 6A and 6B, the attaching member 60 (FIG. 4B) is not shown.

A position where the triangular obstacle 55 is formed and an attaching position of the sensor 531 are explained with reference to FIGS. 7A and 7B.

Figure 7A:
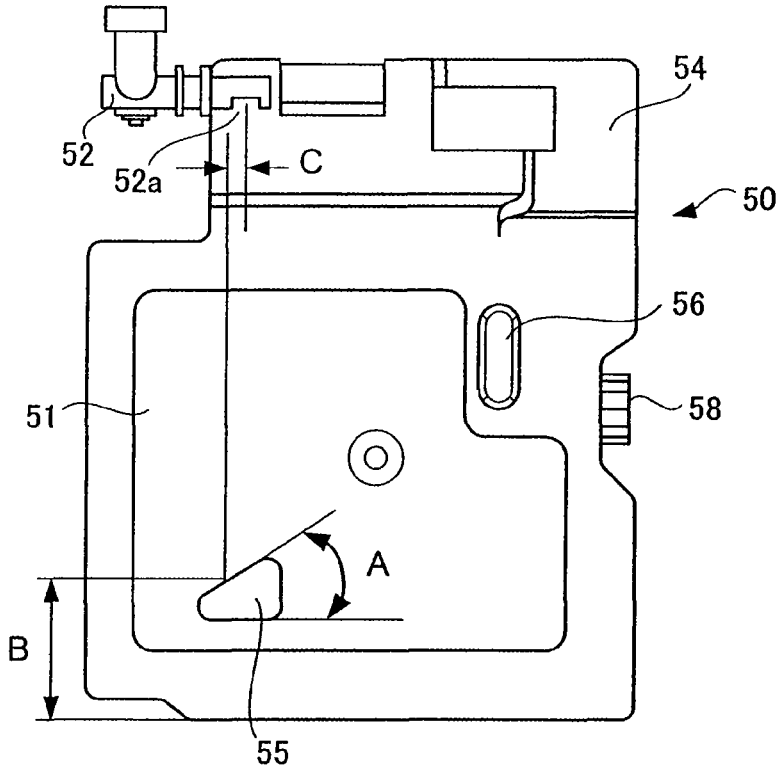
FIGS. 7A and 7B are front views for explaining a setting position of an obstacle and an attaching position of a sensor in the waste toner box.

FIG. 7A shows distances and an angle set in determining a position of the obstacle 55. An angle A is an angle of the inclined surface with respect to the base of the triangular obstacle 55. A distance B is a distance from the center of the inclined surface to a bottom surface of the main body 51. A distance C is a distance between the center point of the waste toner falling port 52*a* and the center point of the inclined surface.

When a position of the obstacle 55 was determined, deposit states of a waste toner were measured by changing the angle A and distances B and C. Deposit states of the waste toner were also measured by changing the content of a carrier included in the waste toner.

According to several experiments performed, a deposit state (a mountain shape) of the waste toner is stabilized when the angle A is about 30 degrees with respect to the bottom surface of the main body 51. Concerning the distance B, the deposit state of the waste toner is more stabilized when the obstacle 55 is in a position close to the bottom surface of the main body 51 than in a position close to the collection port 52. The deposit state of the waste toner is more stabilized when the center of the inclined surface of the obstacle 55 is in a position of the distance C slightly away from the center of the waste toner falling port 52*a* than when the waste toner is dropped to the center of the inclined surface of the obstacle 55.

Figure 7B:
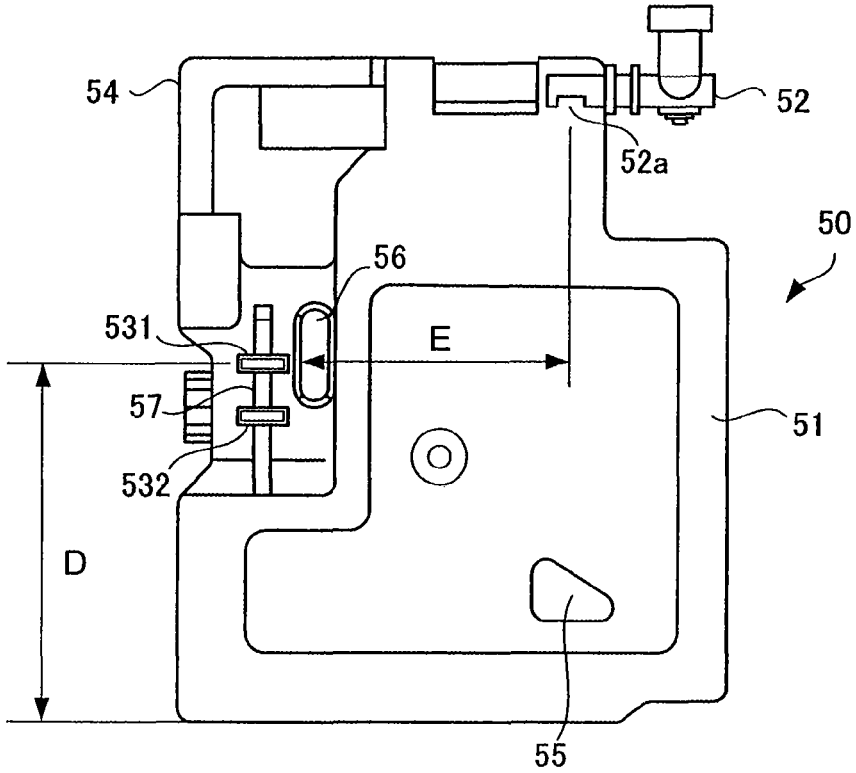

FIG. 7B shows distances set in determining a position of the sensor 531. A distance D is a distance from the sensor 531 to the bottom surface of the main body 51 (height). A distance E is a distance from a perpendicular line of the waste toner falling port to the sensor 531.

It is meaningless to provide the sensor 531 in an excessively low position. The full of the box 50 cannot be detected when the sensor 531 is provided in an excessively high position. Therefore, a height position where the sensor 531 is set (the distance D) is set in a position slightly lower than the top of the long hole 56 on the basis of a deposit state of the waste toner. Concerning the distance E, the perpendicular line is suitably in a position between the long hole 56 and the side of the main body 51.

An example of an experiment result is explained below.

Figure 8A:
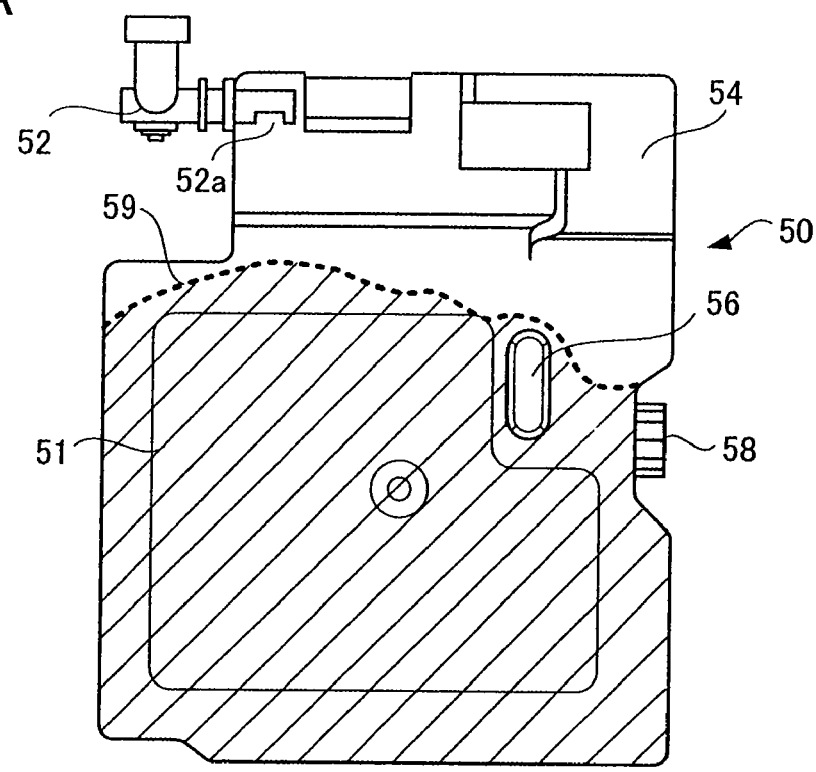
FIGS. 8A and 8B are front views showing deposit states of a waste toner deposited when the obstacle is not provided in the waste toner box.
Figure 8B:
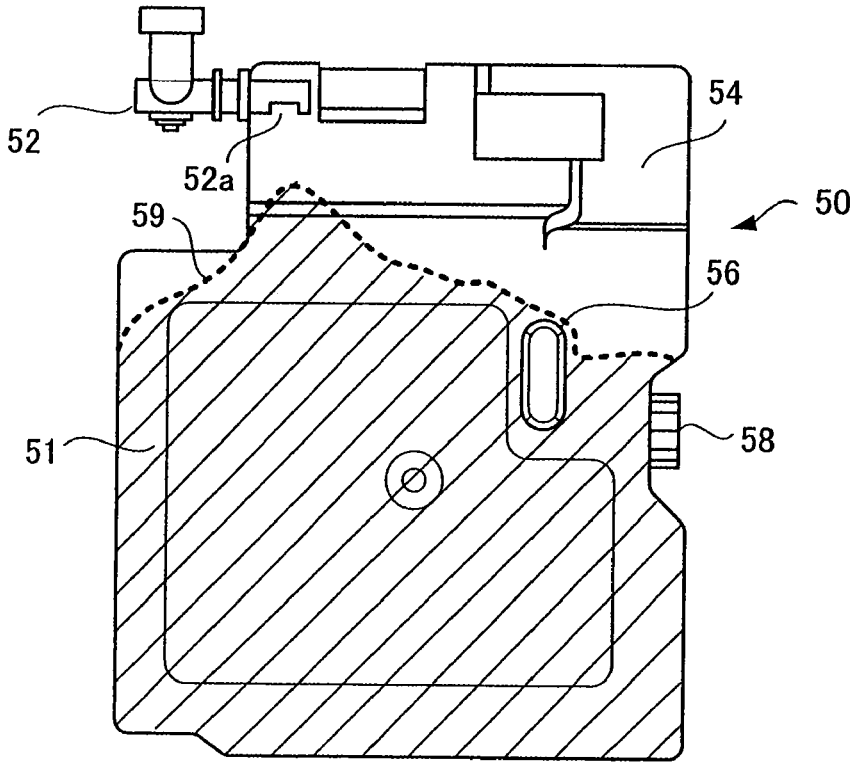

Dotted lines 59 in FIGS. 8A and 8B indicate a deposit state of the waste toner deposited when the triangular obstacle 55 is not provided. In FIG. 8A, the content of the carrier included in the waste toner is small. In FIG. 8B, the content of the carrier included in the waste toner is large.

As it is seen from FIGS. 8A and 8B, when the obstacle 55 is not provided, a mountain shape of the waste toner 59 is different depending on the content of the carrier. When the content of the carrier is small, the mountain shape is relatively gentle. As the content of the carrier increases, the waste toner is deposited high in a portion right below the falling port 52*a*. Therefore, the detection of the full of the box 50 by the sensor 53 changes according to the content of the carrier.

Figure 9A:
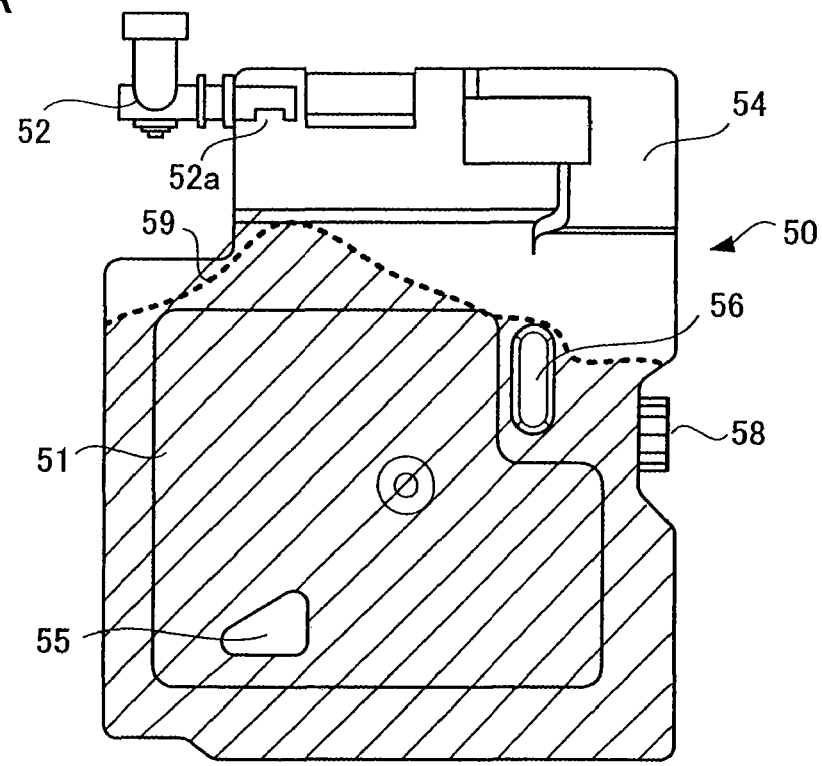
FIGS. 9A and 9B are front views showing a deposit state of the waste toner deposited when the obstacle is provided in the waste toner box.
Figure 9B:
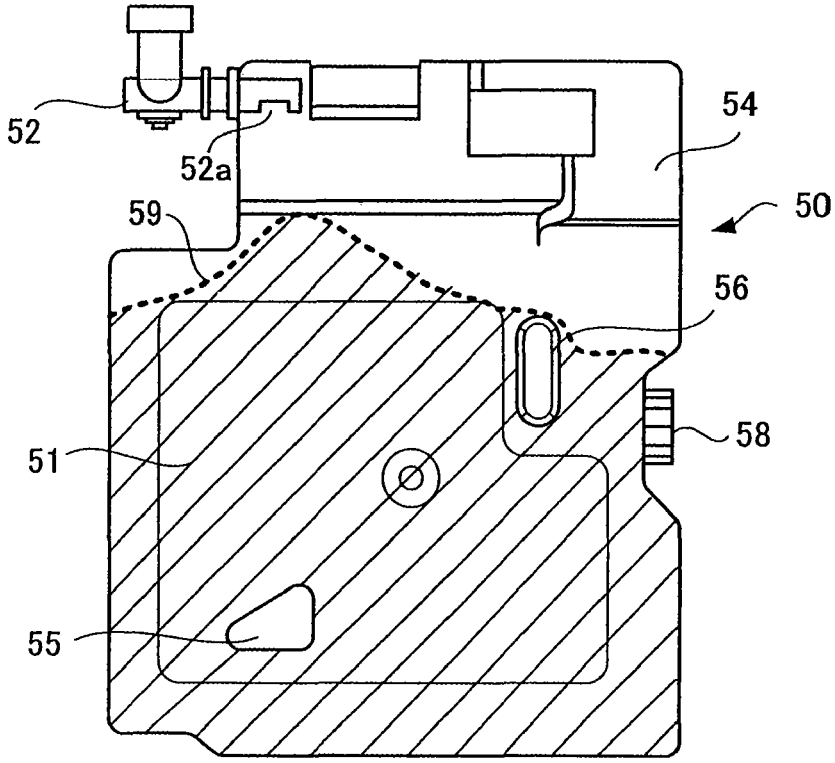

On the other hand, FIGS. 9A and 9B show a deposit state of the waste toner deposited when the triangular obstacle 55 is provided. A dotted lines 59 in FIG. 9A indicates a state in which the content of the carrier included in the waste toner is small. A dotted lines 59 in FIG. 9B indicates a state in which the content of the carrier included in the waste toner is large.

It is seen from FIGS. 9A and 9B that, when the obstacle 55 is provided, the waste toner 59 is deposited substantially the same shapes regardless of whether the content of the carrier is large or small. Therefore, the sensor 53 can stably detect the full of the box 55.

When the triangular obstacle 55 is formed in the box 50, a base of a mountain of the waste toner is formed by the obstacle 55 in an initial stage when the waste toner in the box 50 is little. In the initial stage, since the waste toner slips down on the inclined surface of the obstacle 55, the waste toner does not pile up high on the obstacle 55 and the mountain of the waste toner is prevented from piling up too high. Therefore, when the box 50 is full, a similar mountain shape of the waste toner is formed.

When the waste toner in the box 50 gradually increases to be higher than the long hole 56, the waste toner that crosses over the long hole 56 deposits in the projection 57. The sensor 532 detects the near full and, then, the sensor 531 detects the full.

The near-full detection sensor 532 is used to notify a user that the box 50 is nearly full and urge the user to prepare the box 50 for replacement.

As described above, according to the embodiment of the present invention, it is possible to form the waste toner deposited in the box 50 substantially the same shape regardless of the content of the carrier and stabilize detection of the full by the sensor 531.

When the hole 55 and the long hole 56 are too large, an amount of the waste toner that can be stored in the box 50 decreases. Therefore, it is undesirable to form the hole 55 and the long hole 56 too large.

The present invention is not limited to the embodiment described above. Various modifications of the embodiment are possible. For example, the first obstacle 55 is not limited to the hole 55 of a tunnel shape and may be a triangular bridge that connects the front surface and the rear surface of the main body 51. Similarly, the second obstacle is not limited to the long hole 56 and may be a bridge that connects the front surface and the rear surface of the main body 51.

Although exemplary embodiments are shown and described, it will be apparent to those having ordinary skill in the art that a number of changes, modifications, or alterations as described herein may be made, none of which depart from the spirit. All such changes, modifications, and alterations should therefore be seen as within the scope.

What is claimed is:

1. A waste toner collecting device that collects a waste toner unnecessary in image formation, the waste toner collecting device comprising:

a box that stores the waste toner;

a collection port that is provided in an upper part of a main body of the box, receives the waste toner, and drops the waste toner into the box;

a triangular obstacle provided in a position opposed to a falling port for the waste toner and near a bottom surface in the box, the triangular obstacle includes a hole of a tunnel shape provided to pierce from a front surface to a rear surface of the main body; and a sensor that is provided in a position lower than the collection port and higher than the obstacle and detects that an amount of the waste toner stored in the box reaches a predetermined amount.

2. The device according to claim 1, wherein, in the box, a cap used to close the collection port is attached to a side of the main body.

3. A waste toner collecting device that collects a waste toner unnecessary in image formation, the waste toner collecting device comprising:

a box that stores the waste toner;

a collection port that is provided in an upper part of a main body of the box, receives the waste toner, and drops the waste toner into the box;

a triangular obstacle provided in a position opposed to a falling port for the waste toner and near a bottom surface in the box, a base in the triangular obstacle is parallel to a bottom surface of the box and a surface thereof opposed to the falling port for the waste toner is inclined; and a sensor that is provided in a position lower than the collection port and higher than the obstacle and detects that an amount of the waste toner stored in the box reaches a predetermined amount.

4. The device according to claim 3, wherein, in the box, a cap used to close the collection port is attached to a side of the main body.

5. The device according to claim 3, wherein an angle of the inclined surface of the triangular obstacle is about 30 degrees.

6. The device according to claim 3, wherein a center of the inclined surface of the triangular obstacle deviates from a position of a center of the falling port for the waste toner.

7. A waste toner collecting device that collects a waste toner unnecessary in image formation, the waste toner collecting device comprising:

a box that stores the waste toner;

a collection port that is provided in an upper part of a main body of the box, receives the waste toner, and drops the waste toner into the box;

a triangular obstacle provided in a position opposed to a falling port for the waste toner and near a bottom surface in the box;

a hollow projection formed to protrude in a vertical direction in a position lower than the collection port of the main body and higher than the obstacle;

a sensor attached to the projection and detects that an amount of the waste toner stored in the box reaches a predetermined amount; and a second obstacle including a long hole parallel to the projection is formed near an attaching position of the sensor of the main body.

8. The device according to claim 7, wherein, in the box, a cap used to close the collection port is attached to a side of the main body.

9. A waste toner collecting device that collects a waste toner unnecessary in image formation, the waste toner collecting device comprising:

a box that stores the waste toner;

a collection port that is provided in an upper part of a main body of the box, receives the waste toner, and drops the waste toner into the box;

a triangular obstacle provided in a position opposed to a falling port for the waste toner and near a bottom surface in the box;

a hollow projection formed to protrude in a vertical direction in a position lower than the collection port of the main body and higher than the obstacle; and a sensor that is provided in a position lower than the collection port and higher than the obstacle and detects that an amount of the waste toner stored in the box reaches a predetermined amount, includes a first sensor that is attached to the projection and detects that the box is filled with the waste toner and a second sensor that is attached to a position lower than the first sensor and detects that the box is nearly full.

10. The device according to claim 9, wherein, in the box, a cap used to close the collection port is attached to a side of the main body.

11. An image forming apparatus comprising:

a printer unit that forms a toner image on an image bearing member;

a cleaner that removes a waste toner unnecessary in the printer unit;

a carrying unit that carries the waste toner removed by the cleaner; and a waste toner box that stores the carried waste toner, wherein the waste toner box includes:

a collection port that is provided in an upper part of a main body of the box, receives the waste toner, and drops the waste toner into the box;

a triangular obstacle provided in a position opposed to a falling port for the waste toner and near a bottom surface in the box, the triangular obstacle includes a hole of a tunnel shape provided to pierce from a front surface to a rear surface of the main body; and a sensor attaching section that is integrally formed in a position of the box lower than the collection port and higher than the obstacle and to which a sensor that detects an amount of the waste toner stored in the box.

12. The apparatus according to claim 11, wherein a based in the triangular obstacle is parallel to a bottom surface of the box and a surface thereof opposed to the falling port for the waste toner is inclined.

13. The apparatus according to claim 12, wherein an angle of the inclined surface of the triangular obstacle is about 30 degrees.

14. The apparatus according to claim 12, wherein a center of the inclined surface of the triangular obstacle deviates from a position of a center of the falling port for the waste toner.

15. The apparatus according to claim 11, wherein, in the box, a cap used to close the collection port is attached to a side of the main body.

16. An image forming apparatus comprising:

a printer unit that forms a toner image on an image bearing member;

a cleaner that removes a waste toner unnecessary in the printer unit;

a carrying unit that carries the waste toner removed by the cleaner; and a waste toner box that stores the carried waste toner, wherein the waste toner box includes:

a collection port that is provided in an upper part of a main body of the box, receives the waste toner, and drops the waste toner into the box;

a triangular obstacle provided in a position opposed to a falling port for the waste toner and near a bottom surface in the box;

a projection formed in a vertical direction to protrude from the box that is integrally formed in a position of the box lower than the collection port and higher than the obstacle;

a sensor attached to the projection and detects an amount of the waste toner stored in the box; and a second obstacle including a long hole is formed near and in parallel to the projection.

17. The apparatus according to claim 16, wherein, in the box, a cap used to close the collection port is attached to a side of the main body.

18. An image forming apparatus comprising:

a printer unit that forms a toner image on an image bearing member;

a cleaner that removes a waste toner unnecessary in the printer unit;

a carrying unit that carries the waste toner removed by the cleaner; and a waste toner box that stores the carried waste toner, wherein the waste toner box includes:

a collection port that is provided in an upper part of a main body of the box, receives the waste toner, and drops the waste toner into the box;

a triangular obstacle provided in a position opposed to a falling port for the waste toner and near a bottom surface in the box;

a projection formed in a vertical direction to protrude from the box that is integrally formed in a position of the box lower than the collection port and higher than the obstacle;

a sensor attached to the projection and detects an amount of the waste toner stored in the box, includes a first sensor that is attached to the projection and detects that the box is filled with the waste toner and a second sensor that is attached to a position of the projection lower than the first sensor and detects that the box is nearly full.

19. The apparatus according to claim 18, wherein, in the box, a cap used to close the collection port is attached to a side of the main body.

20. A waste toner collecting device that collects a waste toner unnecessary in image formation, the waste toner collecting device comprising:

a box that stores the waste toner;

a collection port that is provided in an upper part of a main body of the box, receives the waste toner, and drops the waste toner into the box;

an obstacle provided in a position opposed to a falling port for the waste toner and near a bottom surface in the box, the obstacle includes a hole of a tunnel shape provided to pierce from a front surface to a rear surface of the main body; and a sensor that is provided in a position lower than the collection port and higher than the obstacle and detects that an amount of the waste toner stored in the box reaches a predetermined amount.

21. A waste toner collecting device that collects a waste toner unnecessary in image formation, the waste toner collecting device comprising:

a box that stores the waste toner;

a collection port that is provided in an upper part of a main body of the box, receives the waste toner, and drops the waste toner into the box;

an obstacle provided in a position opposed to a falling port for the waste toner and near a bottom surface in the box, a base in the obstacle is parallel to a bottom surface of the box and a surface thereof opposed to the falling port for the waste toner is inclined; and a sensor that is provided in a position lower than the collection port and higher than the obstacle and detects that an amount of the waste toner stored in the box reaches a predetermined amount.

22. A waste toner collecting device that collects a waste toner unnecessary in image formation, the waste toner collecting device comprising:

a box that stores the waste toner;

a collection port that is provided in an upper part of a main body of the box, receives the waste toner, and drops the waste toner into the box;

an obstacle provided in a position opposed to a falling port for the waste toner and near a bottom surface in the box, a center of an inclined surface of the obstacle deviates from a position of a center of the falling port for the waste toner; and a sensor that is provided in a position lower than the collection port and higher than the obstacle and detects that an amount of the waste toner stored in the box reaches a predetermined amount.

* * * * *